US006619987B2

(12) United States Patent
Kumamoto et al.

(10) Patent No.: US 6,619,987 B2
(45) Date of Patent: Sep. 16, 2003

(54) BALANCED TRANSMISSION CONNECTOR

(75) Inventors: Tadashi Kumamoto, Shinagawa (JP); Manabu Shimizu, Shinagawa (JP); Junichi Akama, Shinagawa (JP); Yoshinori Sata, Shinagawa (JP); Hideo Miyazawa, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 09/988,024

(22) Filed: Nov. 16, 2001

(65) Prior Publication Data

US 2003/0036310 A1 Feb. 20, 2003

(30) Foreign Application Priority Data

Aug. 20, 2001 (JP) ..... 2001-249125

(51) Int. Cl.[7] ..... H01R 9/09
(52) U.S. Cl. ..... 439/610; 439/947; 439/521
(58) Field of Search ..... 439/610, 904, 439/901, 906, 76.1, 76.2, 407–409, 521, 108, 947; 174/35 R, 261, 760

(56) References Cited

U.S. PATENT DOCUMENTS 5,419,722 A * 5/1995 Onoda ..... 439/752
6,135,818 A 10/2000 Lang et al. ..... 439/610

FOREIGN PATENT DOCUMENTS

JP 2000-068007 3/2000

* cited by examiner

*Primary Examiner*—Alexander Gilman
(74) *Attorney, Agent, or Firm*—Staas & Halsey LLP

(57) ABSTRACT

A balanced transmission connector, includes a relay board, a plug body for balanced transmission provided on an end part of the relay board, a cable for balanced transmission connected with another end part of the relay board, and a shield cover assembly covering the relay board, the plug body for balanced transmission, and a part of the cable and including a first half shield cover having slide wall parts, an edge of which has a step-shaped surface including a base flat surface and a raised flat surface extending in parallel and in a longitudinal direction of the edge. The base flat surface is positioned on an interior side of the side walls, and a second half shield cover having side wall parts, an edge of which has a step-shaped surface including a base flat surface and a raised flat surface extending in parallel and in a longitudinal direction of the edge, the base flat surface of the side walls of the second half shield cover positioned on an exterior side of the side walls, wherein the raised flat surface of either one of the first and second half shield covers is in direct contact with the base flat surface of another one of the first and second half shield covers in an engaged position in which the first half shield cover and the second half shield cover are connected together.

9 Claims, 13 Drawing Sheets

BALANCED TRANSMISSION CONNECTOR

BACKGROUND OF THE INVENTION

1. Field of the Invention

The present invention generally relates to balanced transmission connectors, and more particularly, to a balanced transmission connector with a cable which is applied for a part of the balanced transmission of data and connects a computer with a peripheral device.

2. Description of the Related Art

A cable and connector unit, in which connectors are connected with both ends of the cable, is used for connecting a personal computer with a peripheral device. Data are transmitted between the personal computer and the peripheral device, by connecting respective connectors which are at the respective ends of the cable with the personal computer and the peripheral device.

There are two methods as data transmission methods. One is a normal transmission method and the other is a balanced transmission method. In the normal transmission method, one electric wire is used for every datum. Contrary, in the balanced transmission method, a pair of electric wires are used for every datum. A "+" signal to transmit and a "−" signal are simultaneously transmitted in the balanced transmission method. A magnitude of the "−" signal is equal to that of the "+" signal. A direction of the "−" signal is reverse to that of the "+" signal. Use of the balanced transmission method is on the increase for data transmission because the balanced transmission method has an advantage in that it is more robust against a noise than the normal transmission method.

With the recent development of personal computers and networks thereof, systems are required for transmitting a large amount of data of, especially, moving pictures, video images, or the like. In order to transmit a large amount of dynamic image data, it is necessary to transmit data at a high data transmission rate, more than 1 gigabit/sec.

In case of that the data transmission is implemented at high rate such as more than 1 gigabit/sec, a wavelength of the signal is short. Therefore, an electromagnetic wave occurring in an inside of the connector can easily leak to outside of the connector. Thus, it is necessary to take measure as to an electromagnetic interference (EMI) for a balanced transmission connector with a cable.

An applicant of the present patent application filed a Japanese patent application, which was published as a Japanese Laid-Open Patent Application No. 2000-068007, "Balanced-Transmission Cable-And-Connector Unit". In this patent application, a balanced transmission connector with a wire has a structure in which a plug for a balanced transmission is inserted in a shield cover assembly. The plug for a balanced transmission has a structure in which the pair of the first and the second signal contacts and the ground contact having a board shape are arranged in turn at predetermined intervals in a block made of synthetic resin.

FIGS. 1A and 1B are views showing a conventional shield cover assembly. Referring to FIG. 1A, a shield cover assembly 140 includes a first half shield cover 141 and a second half shield cover 145 connected together. Flat-surface edges of side wall parts 142 and 143 of the first half shield cover 141 are in contact with flat-surface edges of side wall parts 146 and 147 of the second half shield cover 145.

Referring to FIG. 1B, a shield cover assembly 150 includes a first half shield cover 151 and a second half shield cover 155 connected together. Side wall parts 152 and 153 of the first half shield cover 151 are situated inside side wall parts 156 and 157 of the second half shield cover 155. The side wall part 152 overlaps the side wall part 156. The side wall part 153 overlaps the side wall part 157.

However, in the shield cover assembly 140 shown in FIG. 1A, an "electric gap" may be formed partially at positions where the flat-surface edges of the side wall parts 142 and 143 of the first half shield cover 141 are in contact with the flat-surface edges of the side wall parts 146 and 147 of the second half shield cover 145. The "electric gap" connects straight the inside of the shield cover assembly 140 with the outside thereof. The "electric gap" is defined as a gap having a size through which the electromagnetic wave can pass. Accordingly, the shield cover assembly 140 does not have a sufficient electromagnetic sealability to shield the electromagnetic wave leaking from the inside of the connector to the outside.

On the other hand, the shield cover assembly 150 shown in FIG. 1B has a structure in which the side wall part 152 is covered with the side wall part 156, and the side wall part 153 is covered with the side wall part 157. Accordingly, an "electric gap" is unlikely to be formed between the first half shield cover 151 and the second half shield cover 155. Hence, an electromagnetic sealability of the shield cover assembly 150 is better than that of the shield cover assembly 140 shown in FIG. 1A. However, a width L of the shield cover assembly 150 is increased due to the overlap of the side wall parts 152, 153, 156, and 157 as described above. Hence, the shield cover assembly 150 has a disadvantage in that a size of the balanced transmission connector is big.

SUMMARY OF THE INVENTION

Accordingly, it is a general object of the present invention is to provide a novel and useful balanced transmission connector in which one or more of the problems described above are eliminated.

Another and more specific object of the present invention is to provide a small-size balanced transmission connector having a sufficient electromagnetic sealability to limit an electromagnetic wave leaking from an inside of a balanced transmission connector to an outside of the connector.

The above objects of the present invention are achieved by a balanced transmission connector, including a relay board, a plug body for balanced transmission provided on an end part of the relay board, a cable for balanced transmission connected with another end part of the relay board, and a shield cover assembly covering the relay board, the plug body for balanced transmission, and a part of the cable and including a first half shield cover having side wall parts, an edge of which has a step-shaped surface including a base flat surface and a raised flat surface extending in parallel and in a longitudinal direction of the edge, the base flat surface positioned on an interior side of the side walls, and a second half shield cover having side wall parts, an edge of which has a step-shaped surface including a base flat surface and a raised flat surface extending in parallel and in a longitudinal direction of the edge, the base flat surface of the side walls of the second half shield cover positioned on an exterior side of the side walls, wherein the raised flat surface of either one of the first and second half shield covers is in direct contact with the base flat surface of another one of the first and second half shield covers in an engaged position in which the first half shield cover and the second half shield cover are connected together. Alternatively, a shield cover assembly may include a first half shield cover which includes a side wall part having an edge, a second half shield cover which includes a side wall part having an edge which faces to the edge of the side wall part of the first half shield cover, a concave part which is formed on the edge of the side wall part of either first or second half shield cover and extends in an longitudinal direction of the side wall part, and a convex part which is formed on the edge of the side wall part of another half shield cover, clamps the concave part and extends in an longitudinal direction of the side wall part, thereby the first half shield cover and the second half shield cover can be connected together.

According to the above invention, it is possible to insure that there is no "electric gap"between the first and second half shield covers, by contacting the end edges of the side wall parts of the respective half shield covers. Also, the generation of "electric gaps" between the first and second half shield covers, can be prevented by making all the necessary provisions within the width at a single side wall part. Hence, it is possible to limit the electromagnetic wave leaking from the relay board and the like, without increasing the width of the shield cover assembly.

The first half shield cover may further include an outside wall part having an edge and provided outside of the side wall part of the first half shield cover, and a catching part provided on an head end side of the connector, and the second half shield cover may further include an outside wall part having an edge and provided outside of the side wall part of the second half shield cover, and an end part of a longitudinal direction, wherein the catching part of the first half shield cover catches the end part of the second seal half cover and an end of the cable is screw-fixed with the first half shield cover, thereby the edges of the respective outside wall parts of the respective half shield covers are in contact.

According to the above invention, the catching part of the first half shield cover catches the end part of the second seal half cover and an end of the cable is screw-fixed with the first half shield cover. Hence, the end edges of the respective side wall parts of the respective half shield covers are connected together with a high pressing force.

The first half shield cover may further include an outside wall part having an edge and provided outside of the side wall part of the first half shield cover, and the second half shield cover may further include an outside wall part having an edge and provided outside of the side wall part of the second half shield cover, wherein a height position where the edge of the outside wall part of the first half shield cover is in contact with the edge of the outside wall part of the second half shield cover is different from a height position where the edge of the side wall part of the first half shield cover is in contact with the edge of the side wall part of the second half shield cover.

According to the invention, the outside wall part faces to the position where the end edge of the side wall part of the first half shield cover and the end edge of the side wall part of the second half shield are contacted, so that it may be robust against leaking out of the electromagnetic wave generating in the relay board and the like.

A balanced transmission connector may include a relay board, a plug body for balanced transmission provided on an end part of the relay board including a first signal contact, a second signal contact, a ground contact having a plate shape, a groove for the signal contacts, a slit part having a head end, and a connecting part, a cable for balanced transmission connected with another end part of the relay board, and a shield cover assembly which covers the relay board, the plug body for balanced transmission, and a part of the cable, wherein all or a part of the ground contacts has a convex head part, the first and second signal contacts and the ground contact are arranged in turn at a designated pitch, the first and second signal contacts are inserted into the groove for the signal contacts, the ground contact is inserted and penetrates to the slit part, the slit part has a corresponding configuration to a configuration of the convex head part of the ground contact, and the head end of the slit part is connected by the connecting part.

According to the above invention, the block body has a comb tooth shape because the block body has the slit parts in which a grand contact is inserted. Head end parts of all or a part of a comb tooth parts is connected, so that the mechanical strength of the block body can be kept.

The above objects of the present invention are also achieved by a shield cover assembly, including a first half shield cover having side wall parts, and edge of which has a step-shaped surface including a base flat surface and a raised flat surface extending in parallel and in a longitudinal direction of the edge, the base flat surface positioned on an interior side of the side walls, and a second half shield cover having side wall parts, an edge of which has a step-shaped surface including a base flat surface and a raised flat surface extending in parallel and in a longitudinal direction of the edge, the base flat surface of the side walls of the second half shield cover positioned on an exterior side of the side walls, wherein the raised flat surface of either one of the first and second half shield covers is in direct contact with the base flat surface of another one of the first and second half shield covers in an engaged position in which the first half shield cover and the second half shield cover are connected together.

Furthermore, the above objects of the present invention are achieved by a shield cover assembly, including a first half shield cover which includes a side wall part having an edge, a second half shield cover which includes a side wall part having an edge which faces to the edge of the side wall part of the first half shield cover, a concave part which is formed on the edge of the side wall part of either first or second half shield cover and extends in an longitudinal direction of the side wall part, and a convex part which is formed on the edge of the side wall part of another half shield cover, clamps the concave part and extends in an longitudinal direction of the side wall part, thereby the first half shield cover and the second half shield cover can be connected together.

Other objects, features, and advantages of the present invention will be more apparent from the following detailed description when read in conjunction with the accompanying drawings.

DETAIL DESCRIPTION OF THE PREFERED EMBODIMENTS

A description will now be given, with reference to the drawings, of embodiments of the present invention.

Figure 1A:
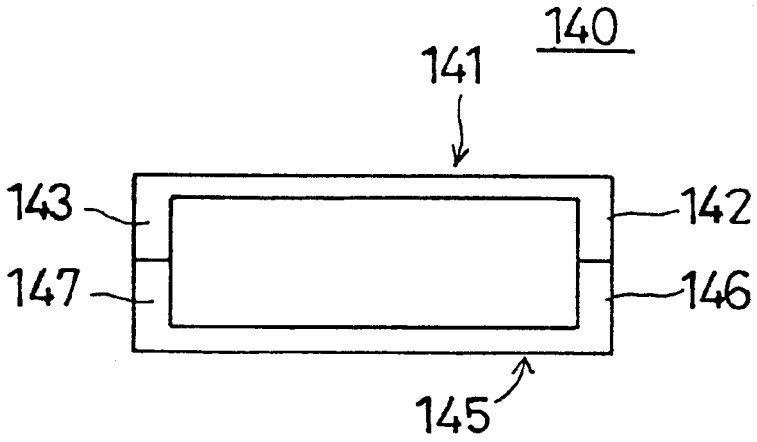
FIG. 1A is a view showing a conventional shield cover assembly.
Figure 1B:
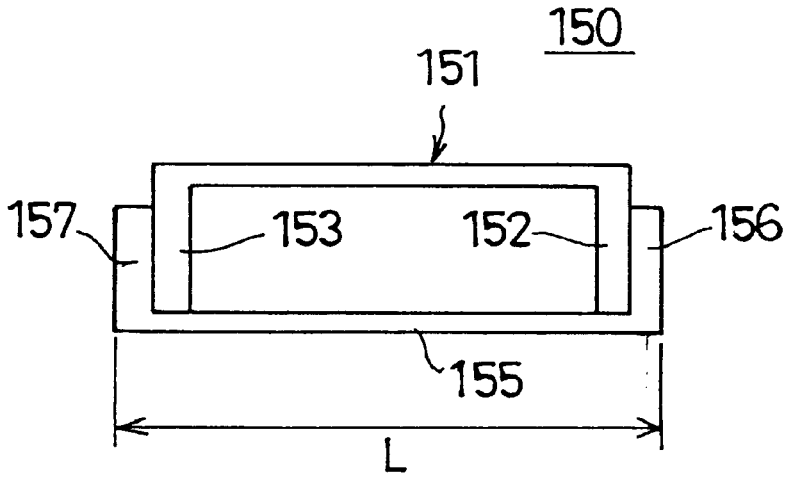
FIG. 1B is a view showing another conventional shield cover assembly.
Figure 2:
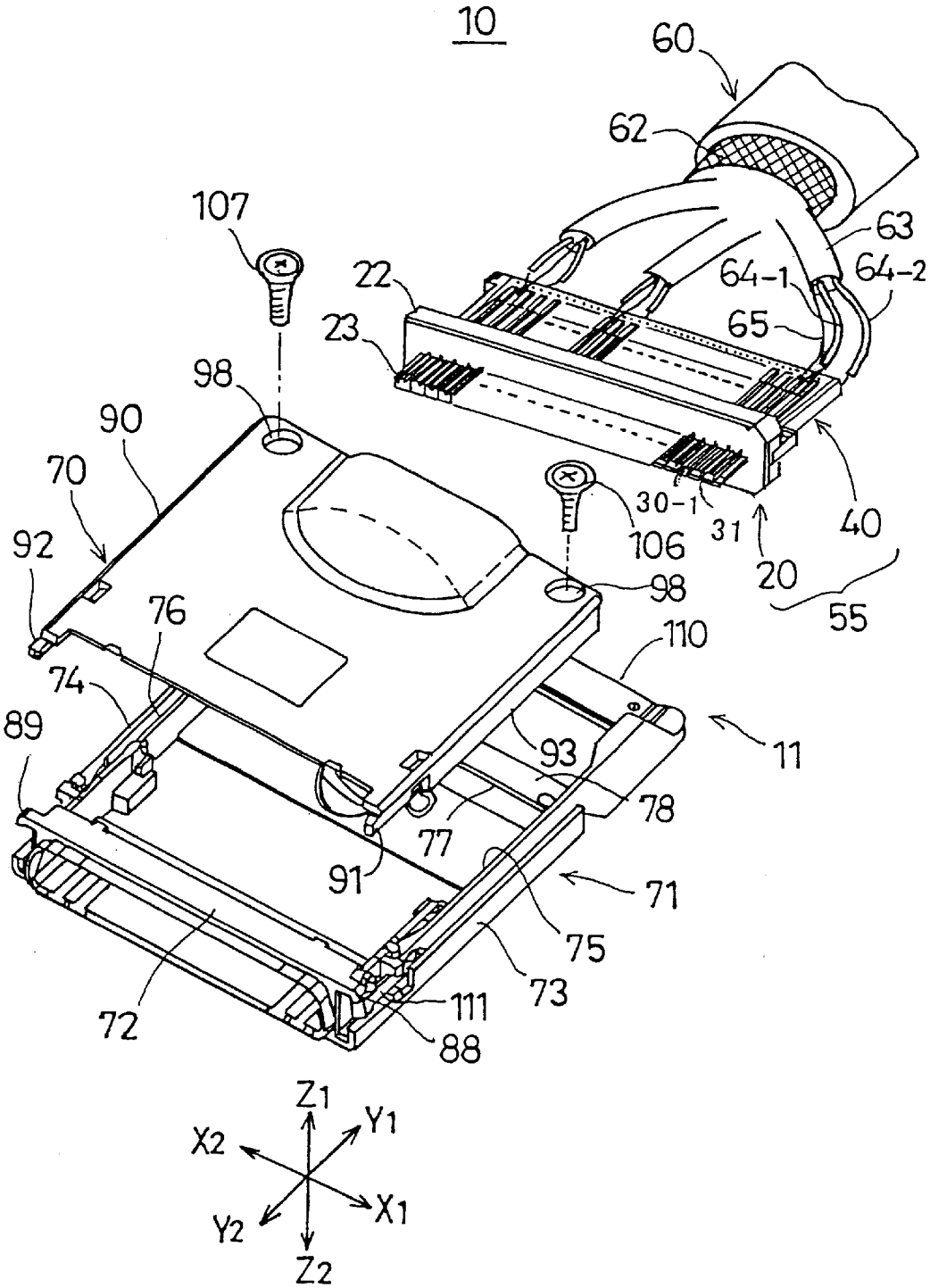
FIG. 2 is an exploded and perspective view showing a first embodiment of a balanced transmission connector according to the present invention.
Figure 3:
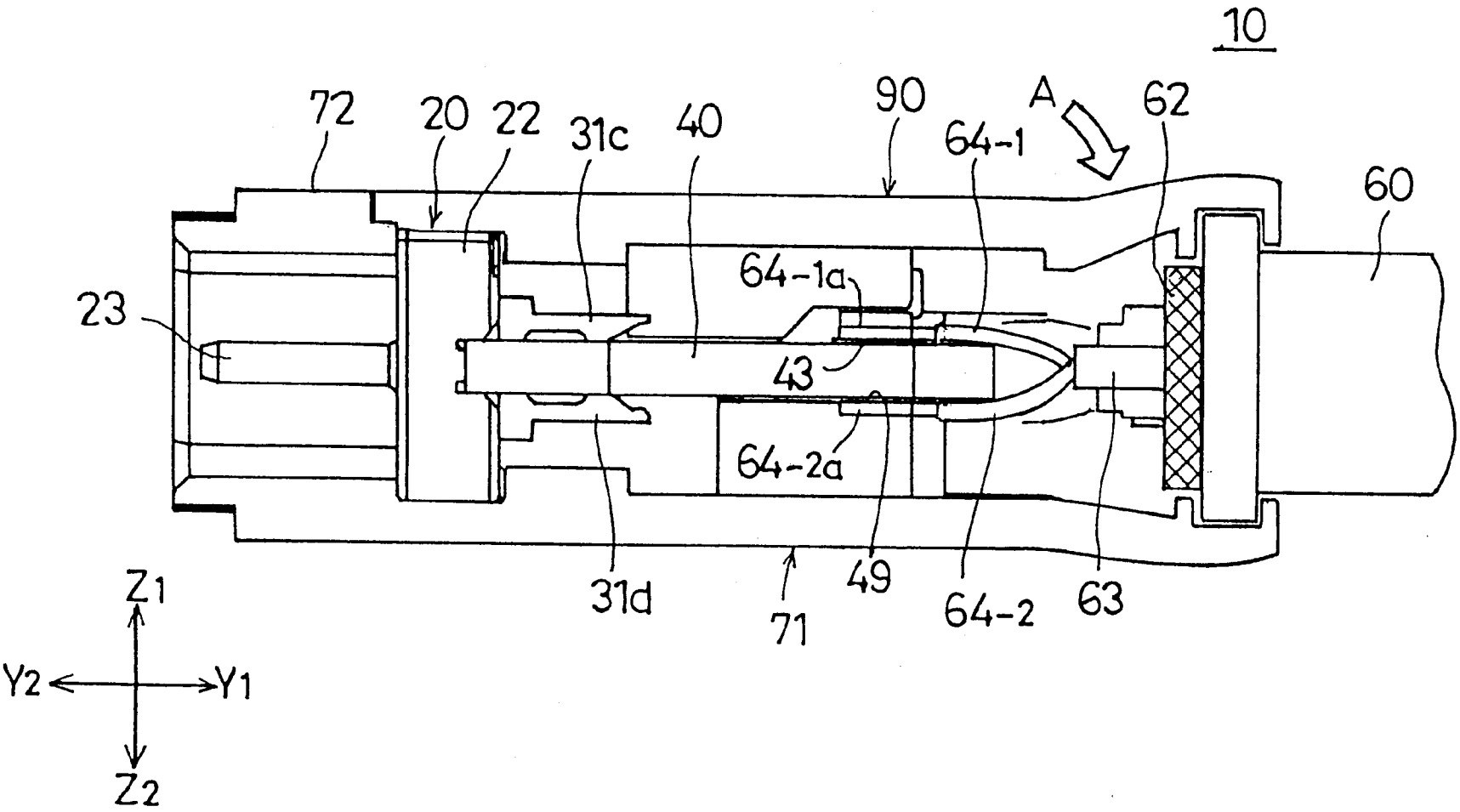
FIG. 3 is a cross sectional view as to Y–Z face showing a first embodiment of the balanced transmission connector according to the present invention.

FIG. 2 is an exploded and perspective view showing a first embodiment of a balanced transmission connector 10 according to the present invention. FIG. 3 is a cross sectional view showing the balanced transmission connector 10. The balanced transmission connector 10 with a cable has a structure in which a balanced transmission connector 11 is located at an end part of a cable 60 for balanced transmission. X1–X2 is a direction in which the width of the connector 11 is defined. Y1–Y2 is a direction in which the longitude of the connector 11 is defined. Z1–Z2 is a direction in which the height of the connector 11 is defined.

The balanced transmission connector 11 includes a balanced transmission plug body 20, a relay board 40, the cable 60 for balanced transmission, and a shield cover assembly 70. The relay board 40 is solder-fixed with a back end part of the balanced transmission plug body 20 (an end part of Y2 direction). The cable 60 for balanced transmission is connected with an end part of Y2 direction of the relay board 40. The balanced transmission plug body 20, the relay board 40, and a part of the cable 60 for balanced transmission are covered with the shield cover assembly 70. The balanced transmission plug body 20 and the relay board 40 form a balanced transmission plug body relay board assembly 55 as enlargedly shown in FIG. 4.

In the following, the balanced transmission plug body 20 will be described.

Figure 5:
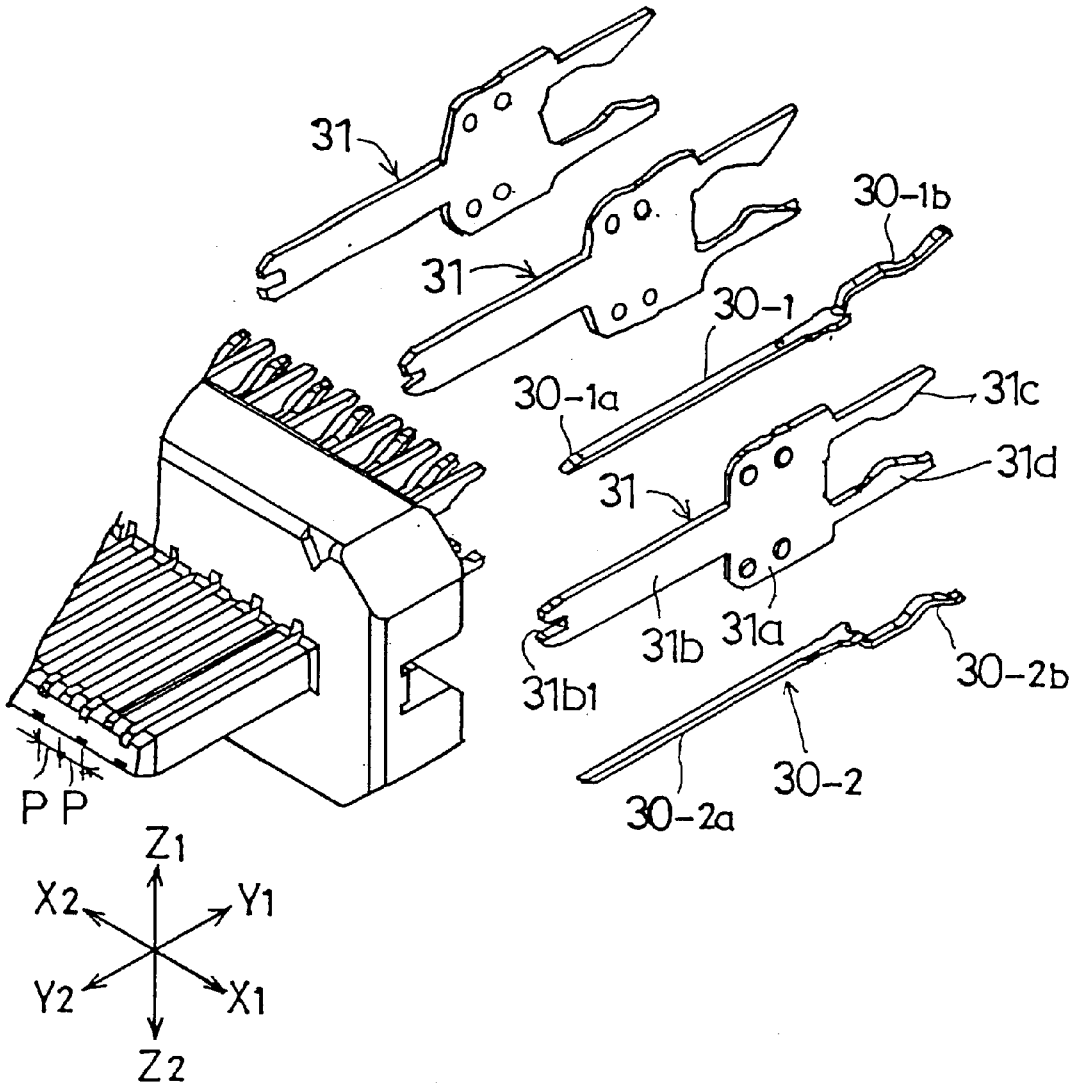
FIG. 5 is an enlarged view showing a part of a balanced transmission plug body.

As enlargedly shown in FIG. 5, the balanced transmission plug body 20 has a block body 21. The block body 21 is a mold part made of synthetic resin having an electric insulation. A pair of a first signal contact 30-1 and a second signal contact 30-2, and a ground contact 31 having a plate shape, are inserted in the block body 21, and arranged in turn at a designated pitch p. The block body 21 serves to electrically insulate theses contacts from each other and securely holds these contacts at the designated pitch.

Figure 6:
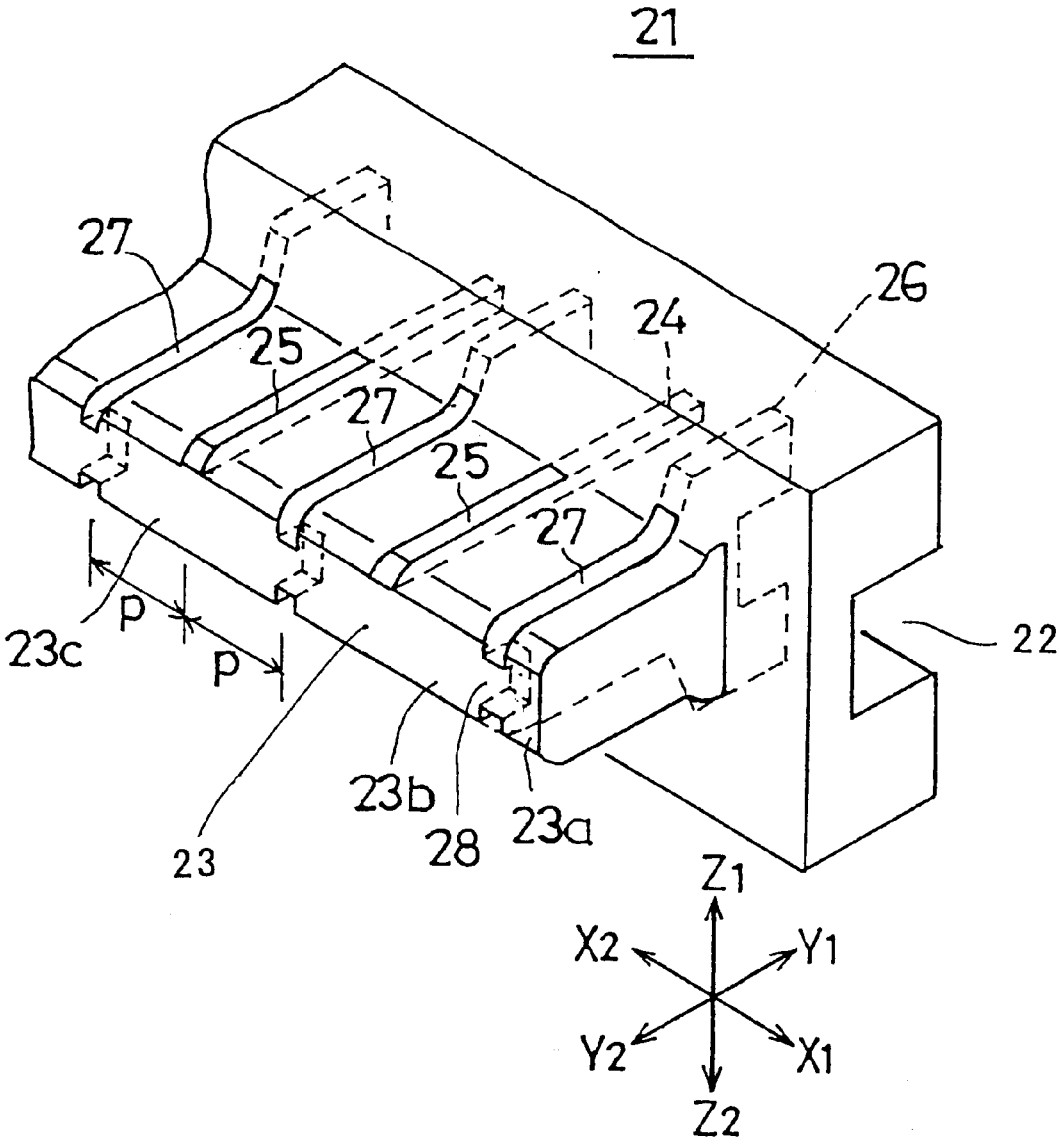
FIG. 6 is an enlarged view showing a part of a block body shown in FIG. 5.

As enlargedly shown in FIG. 6, the block body 21 includes a base part 22 and a projection part 23. The projection part 23 projects from a center of the base part 22 in a Y2 direction and has a plate shape. FIG. 5 is an enlarged, partial view of this structure for the purpose of understanding thereof.

The first signal contact 30-1 includes a contact body 30-1*a* having a stick shape and a terminal part 30-1*b* in a Y1 direction. Similarly, the second signal contact 30-2 includes a contact body 30-2*a* and a terminal part 30-2*b* in a Y1 direction.

(See).

The ground contact 31 includes a basic part 31*a*, a body 31*b*, and terminal parts 31*c* and 31*d*. The body part 31*b* extends from the basic part 31*a* in a Y2 direction and has a slender shape. The terminal parts 31*c* and 31*d* project from the basic part 31*a* in a Y1 direction and have a fork shape. A concave part 31*b*1 is formed at an end part of the body 31*b* on the Y2 side.

As shown in FIG. 6, a tunnel 24 and a groove 25 are formed in the block body 21. The first signal contact 30-1 and the second signal contact 30-2 are inserted from Y2 side into Y1 direction of the tunnel 24 and the groove 25. Tunnels 26 and slits 27, in which the ground contact 31 are inserted, are formed in the block body 21. The tunnel 24 (and the groove 25) and the tunnel 26 (and the slit 27) have an interval of a pitch p. The slit 27 goes through the projection part 23 in the Z1–Z2 direction. In the Y2 direction, however, the slit 27 does not go through all the extent of the projection part 23, and a connection part 28 corresponding to the concave part 31*b* is formed at the end of the projection part 23 on the Y2 side. The projection part 23 is divided into parts by the slits 27, so that the projection part 23 has a comb teeth shape. Comb tooth parts 23*a*, 23*b*, and 23*c* are arranged in turn and in X1–X2 direction. Head end parts of the comb tooth parts 23*a*, 23*b*, and 23*c* are respectively connected by the connection part 28. Therefore, the head end parts of the comb tooth parts 23*a*, 23*b*, and 23*c* are not free. Hence, an accident such that the bent to a convex or concave configuration, may occur. If the balanced transmission plug body is bent due to a bending moment, the signal contacts 30-1 and 30-2 and the ground contact 31 may be deformed. However, in this embodiment, since the head end parts of the comb tooth parts 23*a*, 23*b*, and 23*c* are respectively connected by the connection part 28, the block body 21 or the balanced transmission plug body 20 is sufficiently robust against the bending moment. Therefore, during the connection operation or the removing connection operation, the block body 21 and the balanced transmission plug body 20 are not bent. Hence, it is possible to reliably to avoid a state in which the signal contacts 30-1 and 30-2 and the ground contact 31 are deformed.

The balanced transmission connector 11 is inserted into a jack during a connection operation and pulled out during a removing connection operation. During the connection operation or the removing connection operation, a bending moment, by which a Y2 end side is bend as a convex or concave may occur. If the balanced transmission plug body is bent due to the bending moment, the signal contacts 30-1 and 30-2 and the ground contact 31 may be deformed. However, in this embodiment, since the head end parts of the comp tooth parts 23*a*, 23*b*, and 23*c* are respectively connected by the connection part 28, the block body 21 or the balanced transmission plug body 20 is enough robust against the bending moment. Therefore, during the connection operation or the removing connection operation, the block body 21 and the balanced transmission plug body 20 are not bent. Hence, it is possible to reliably to avoid a state in which the signal contacts 30-1 and 30-2 and the ground contact 31 are deformed.

A ground contact 31 is inserted from Y2 side in the Y1 direction of the tunnel 26 and the slit 27. The concave part 31*b*1 is clamped with the connection part 28. A groove 29 clamped with the relay board 40 is formed on Y1 side of the base part 22.

Next, the relay board 40 will be described.

Figure 4:
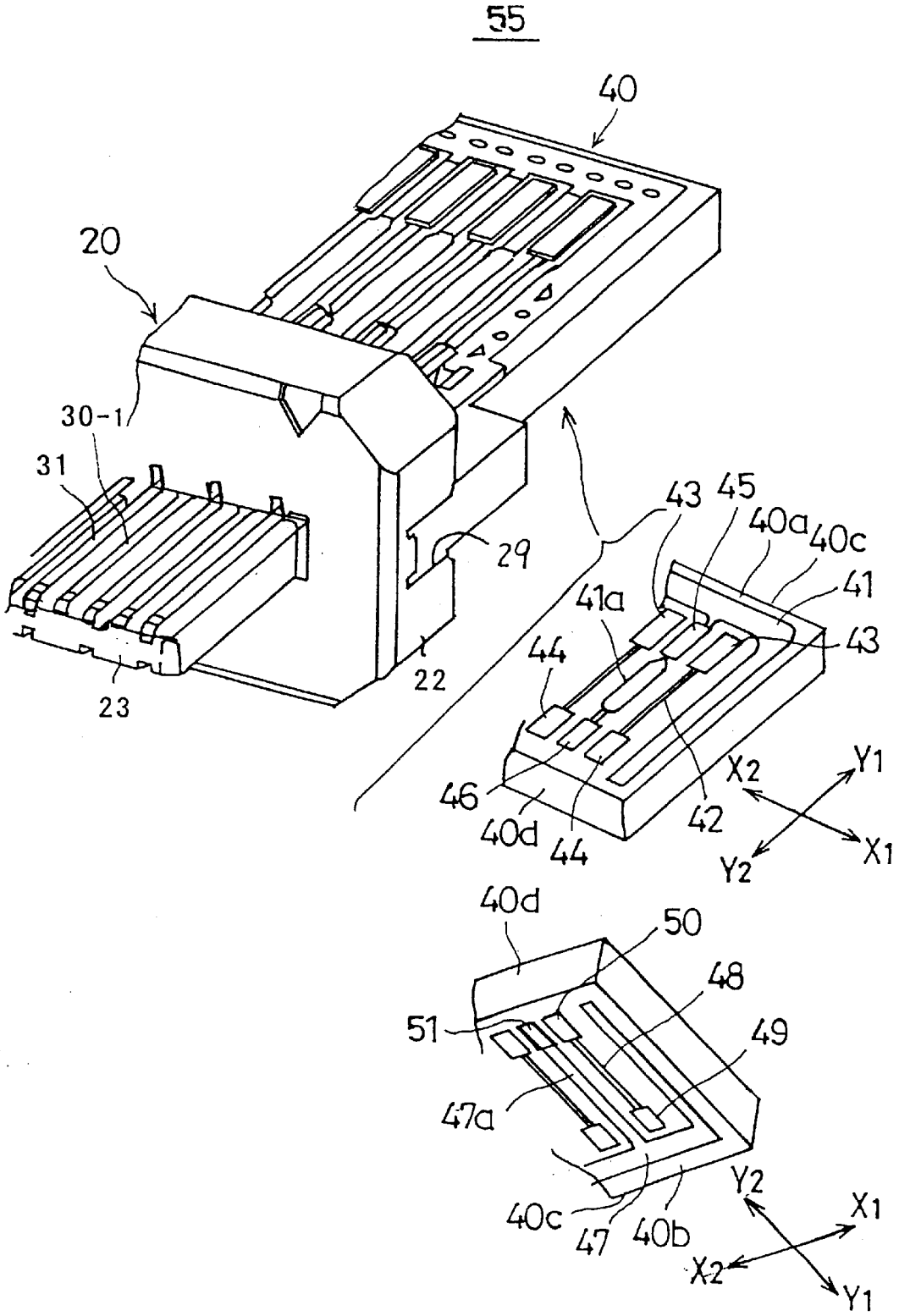
FIG. 4 is an enlarged view showing a part of a balanced transmission plug body—relay board assembly.

As shown in FIG. 4, a ground pattern 41 having a comb tooth shape is formed on an upper surface 40*a* of the relay board 40. A wire pattern 42 is formed between neighboring tooth patterns 41*a*. A pad 43 for a first signal line is formed on an end of Y1 direction of the wire pattern 42. A pad 44 is formed on an end of Y2 direction of the wire pattern 42. A pad 45 for a drain line is formed at a basic part of the tooth pattern 41*a*. A pad 46 is formed on an end of the tooth pattern 41*a*. The pad 43 for the first signal line and the pad 45 for the drain line are formed in turn along a side 40*c* at an end of the Y1 direction. The pad 44 and the pad 46 are also formed in turn along a side 40*d* at an end of the Y2 direction.

The ground pattern 47 having the comb tooth shape is formed on a bottom surface 40*b* of the relay board 40. A wire pattern 48 is formed between neighboring tooth patterns 47*a*. A pad 49 for the second signal line is formed on an end of Y1 direction of the wire pattern 42. A pad 50 is formed on an end in the Y2 direction of the wire pattern 42. A pad 51 is formed on an end of the tooth pattern 47*a*. The pad 49 for the second signal line and the tooth pattern 47*a* are formed in turn along the side 40*c*. The pad 50 and the pad 51 are also formed in turn along a side 40*d*.

The side 40*d* of the relay board 40 is clamped with the groove 29 of the base part 22. The pad 44 on the upper surface of the relay board 40 is solder-fixed with the terminal part 30-1*b*. The pad 46 on the upper surface of the relay board 40 is solder-fixed with the terminal part 31*c*.

The pad 50 on the bottom surface of the relay board 40 is solder-fixed with the terminal part 30-2*b*. The pad 51 on the bottom surface of the relay board 40 is solder-fixed with the terminal part 31*d*. Thus, the relay board 40 is mechanically fixed and electrically connected, with the balanced transmission plug body 20.

Next, the cable 60 for balanced transmission will be described.

Figure 7:
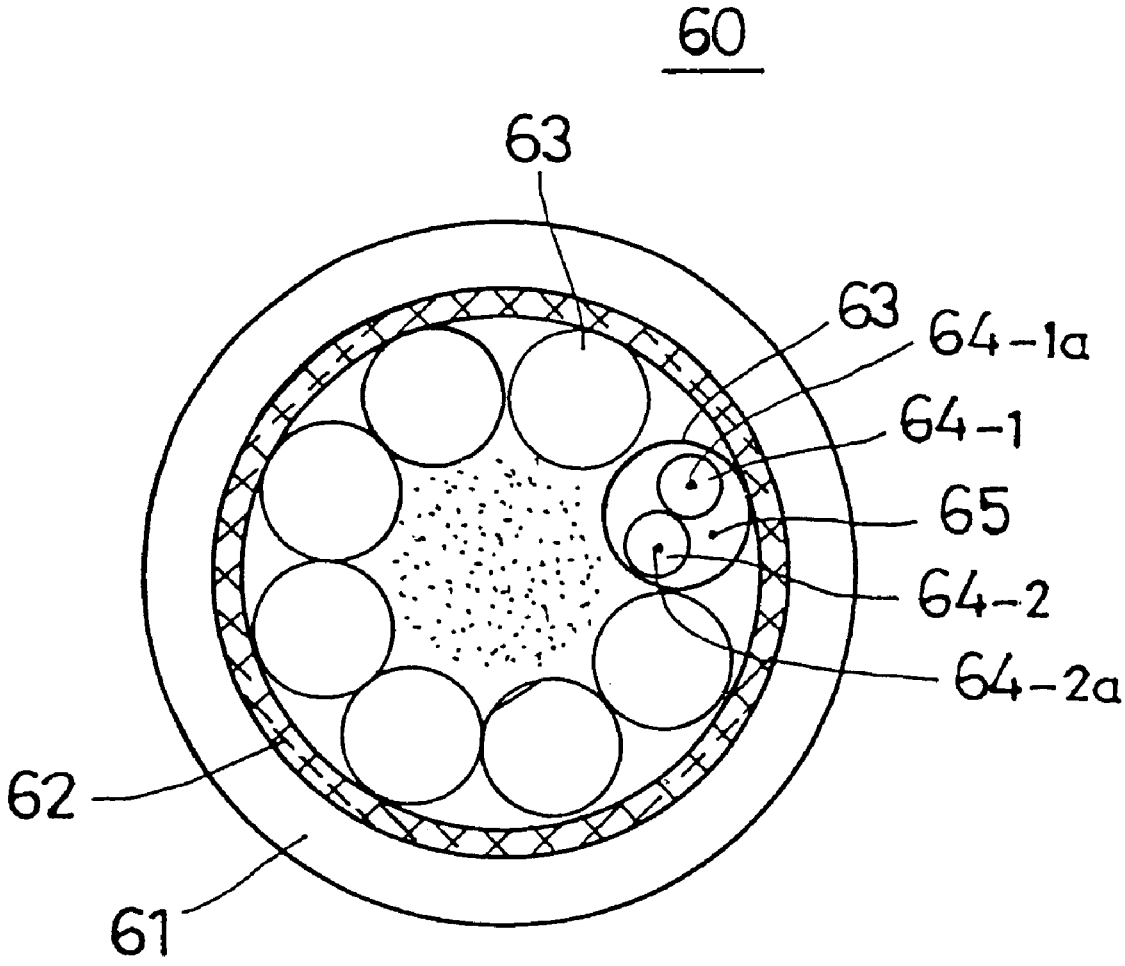
FIG. 7 is a cross sectional view of a balanced transmission cable.

As shown in FIGS. 2 and 7, the cable 60 for balanced transmission has a structure in which a tube-shaped electrically insulating outer covering part 61 and a sub-cable group shielding mesh 62 are arranged, on a cross section perpendicular to an axis line. A plurality of sub-cables 63 are arranged inside of a sub-cable group shielding mesh 62 so as to form a circle for instance. The respective sub-cables 63 include a drain wire 65 in addition to a pair of first and second covered leads 64-1 and 64-2.

As shown in FIG. 3, a lead 64-1*a* of the first covered lead 64-1 is solder-fixed with the pad 43 for the first signal line. The drain wire 65 is solder-fixed with the pad 45 for the drain line. A lead 64-2*a* of the second covered lead 64-2 is solder fixed with the pad 49 for the second signal line.

Next, the shield cover assembly 70 will be described.

Figure 8:
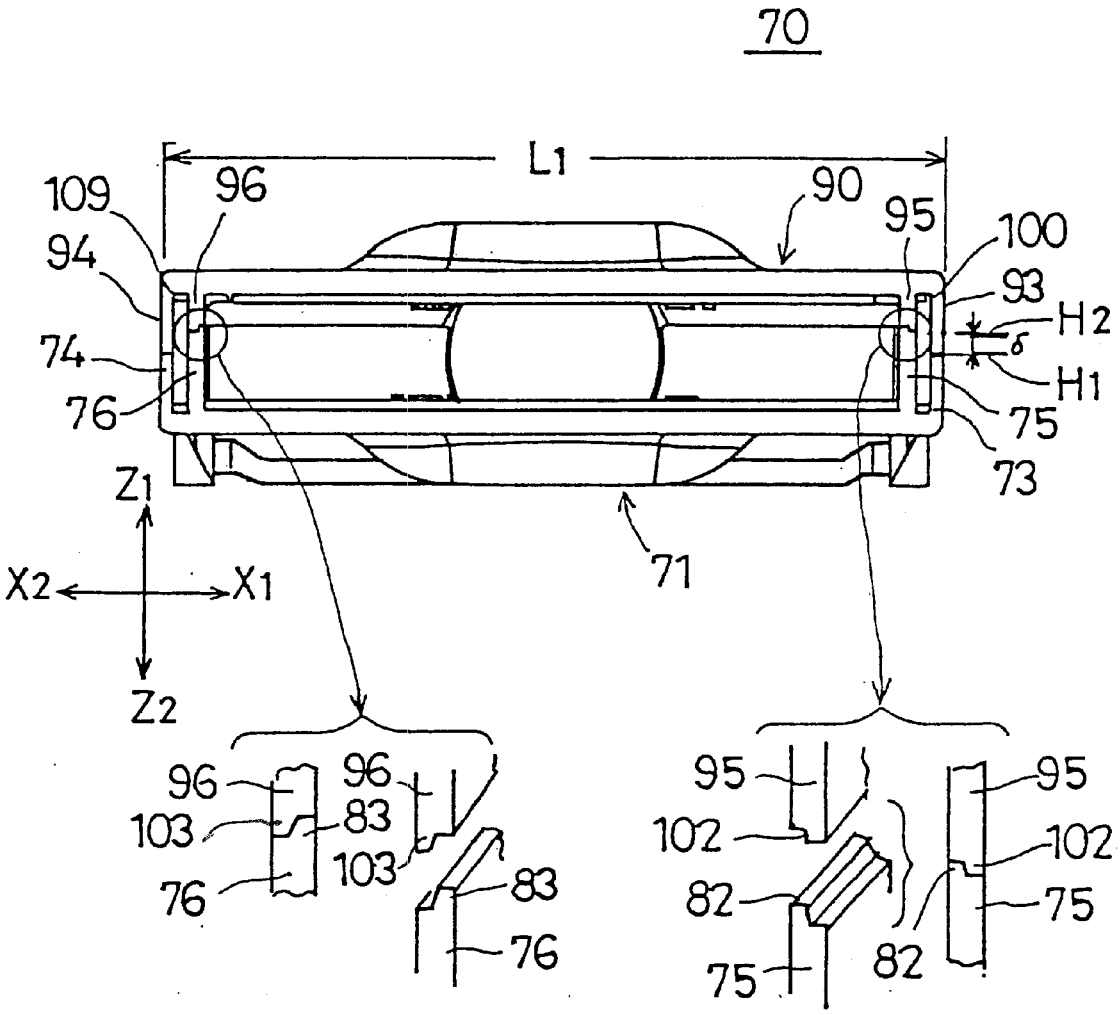
FIG. 8 is a cross sectional view as to X–Z face showing a shield cover assembly.
Figure 9:
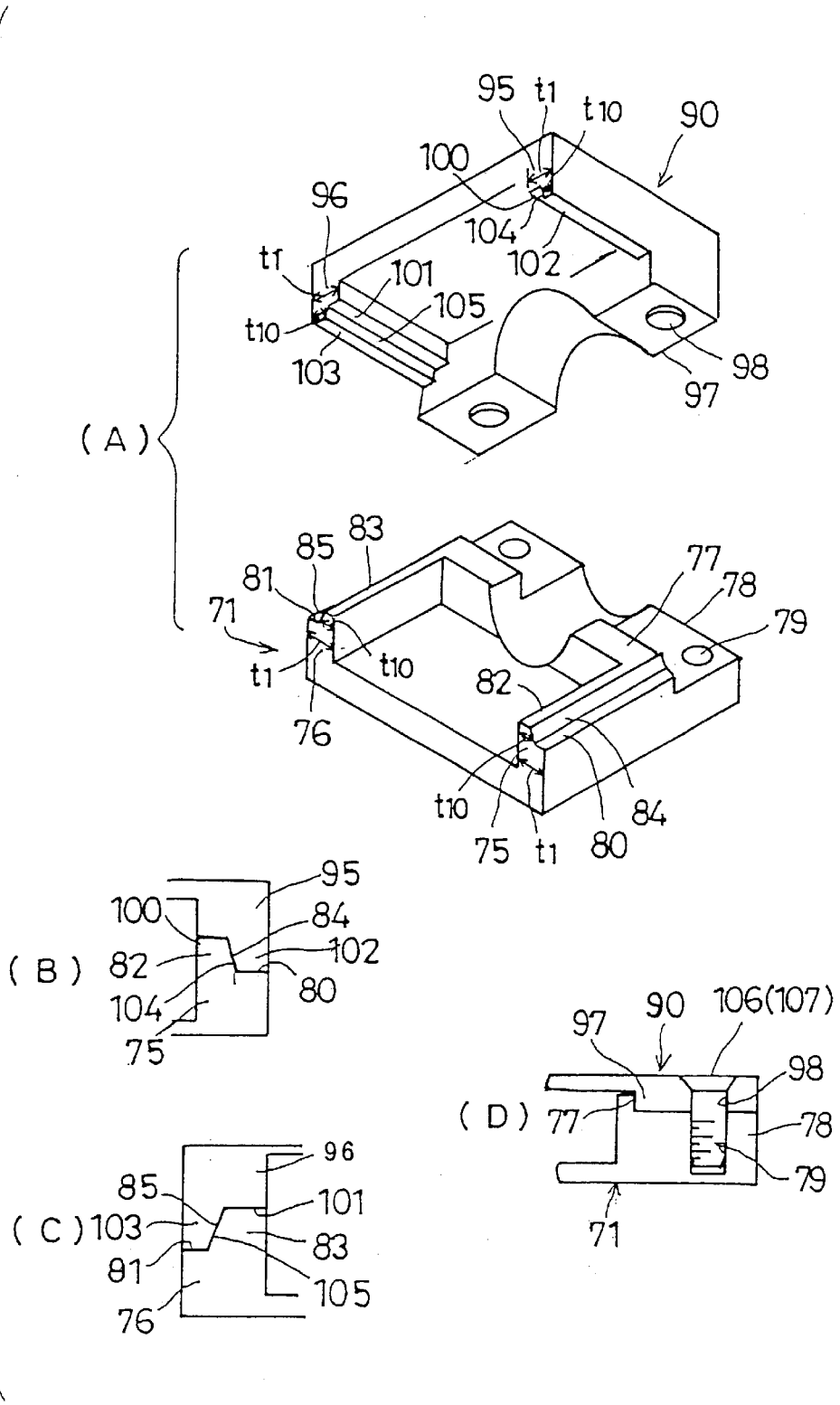
FIG. 9 is a front view roughly showing a shield cover assembly.

As shown in FIGS. 2, 8, and 9-(A) to 9-(D), the shield cover assembly 70 includes a first half shield cover 71 and a second half shield cover 90. The second half shield cover 90 is connected with the first half shield cover 71. The first and second half shield covers 71 and 90 are conductive and made of die-casting zinc which is non magnetic material.

FIG. 9 is a view roughly showing structures of the first and second half shield covers 71 and 90.

The first half shield cover 71 includes a frame part 72, outside wall parts 73 and 74, side wall parts 75 and 76, a wall part 77 and a base part 78. The frame part 72 is provided on an end part of Y2 direction of the first half shield cover 71. The outside wall parts 73 and 74 extending in Y1–Y2 direction are provided on end parts of X1–X2 direction of the first half shield cover 71. The side wall parts 75 and 76 extending in Y1–Y2 direction are provided on just insides of the outside wall parts 73 and 74 of the first half shield cover 71. The wall part 77 and the base part 78 crossing in X1–X2 direction are provided on Y1 direction side of the first half shield cover 71.

Support wall parts 82 and 83 project from base flat surfaces 80 and 81 of edges of side wall parts 75 and 76. Support wall parts 82 and 83 are positioned at interior sides of the side wall parts 75 and 76 and extend in parallel and in a longitudinal direction. Raised flat surfaces are provided on edges of the support wall parts 82 and 83. Thus, edges of the side wall parts 75 and 76 have step-shapes. A width t10 of the support wall parts 82 and 83 is approximately half of a width t1 of the side wall parts 75 and 76. Exterior sides 84 and 85 of the support wall parts 82 and 83 respectively have inclined surfaces and lead to the base flat surfaces 80 and 81.

The frame part 72 has accepting (i.e., catching) parts 88 and 89 at respective, opposite ends of the frame part 72 extending in the X1 and X2 directions, respectively, as seen in FIG. 2.

The second half shield cover 90 includes projection parts 91 and 92, outside wall parts 93 and 94, and side wall parts 95 and 96. The projection parts 91 and 92 are provided on both ends of X1–X2 direction side of an end part of Y2 direction. The outside wall parts 93 and 94 extending in Y1–Y2 direction are provided on end parts of X1–X2 direction. The side wall parts 95 and 96 extend in Y1–Y2 direction and are provided on just inside of the outside wall parts 93 and 94. Edges of the side wall parts 95 and 96 have shapes corresponding to shapes of the upper end edges of the side wall parts 75 and 76. Support wall parts 102 and 103 project from the base flat surface 100 and 101 of edges of the side wall parts 95 and 96. Support wall parts 102 and 103 are positioned at exterior sides of the side wall parts 95 and 96 and extend in parallel and in a longitudinal direction. Raised flat surfaces are provided on edges of the support wall parts 102 and 103. Thus, edges of the side wall parts 95 and 96 have step-shapes. A width t10 of the support wall parts 102 and 103 is approximately half of a width t1 of the side wall parts 95 and 96. Exterior sides 104 and 105 of the support wall parts 102 and 103, having inclined surfaces, respectively lead to the base flat surfaces 100 and 101.

The second half shield cover 90 has a base part 97 crossing to X1–X2 direction and provided on Y1 direction side.

The second half shield cover 90 has a structure where the projection parts 91 and 92 at Y2 end parts are respectively fit with the accepting (i.e., catching) parts 88 and 89 (FIG. 2). (14 Both of Y1 end parts of cover 90, in the X1 and X2 directions, are screw-fixed with the first half shield cover 71 by screws 106 and 107. Hence, the second half shield cover 90 covers the upper surface of the first half shield cover 71. The screws 106 and 107 are driven in tightly at a screw hole 79 on the base part 78 of the first half shield cover 71, through a hole 98 of the base part 97 of the second half shield cover 90 (FIG. 9, Part (A)).

As enlargedly shown in FIG. 8 and shown in FIG. 9-(B), the edges of the side wall parts 75 and 95 are connected together by the respective support wall parts. The support wall parts 82 and 102 are in parallel in X1–X2 direction. The exterior side 84 having the inclined surface is in tight contact with the exterior side 104 having the inclined surface. The raised flat surface of the support wall part 82 is in tight contact with the base flat surface 100. The raised flat surface of the support wall part 102 is in tight contact with the base flat surface 80. Hence, the generation of the "electric gap" does not occur at a part where the edges of the side wall part 75 and the side wall part 95 are in contact.

Also, as enlargedly shown in FIG. 8 and shown in FIG. 9-(C), the edges of the side wall parts 76 and 96 are connected together by the respective support wall parts. The support wall part 83 and 103 are in parallel in X1–X2 direction. The exterior side 85 having the inclined surface 85 is in tight contact with the exterior side 105 having the inclined surface. The raised flat surface of the support wall part 83 is in tight contact with the base flat surface 101. The raised flat surface of the support wall part 103 is in tight contact with the base flat surface 81. Hence, the generation of the "electric gap" does not occur at a part where the edges of the side wall part 76 and the side wall part 96 are in contact.

As described above, in this embodiment, the support wall parts 82 and 102 are in parallel in the X1–X2 direction. Similarly, the support wall parts 83 and 103 are in parallel in the X1–X2 direction. With the above-mentioned structure, the support wall parts 82, 83, 102, and 103 limit to form a gap going through linearly on the X1–X2 direction. Therefore, even if a gap is formed at a part due to that a surface does not have good accuracy and a contact degree is partially weak, the generation of the "electric gap" does not occur.

As described above, because of the edges of the side wall parts 75, 76, 95, and 96, the generation of the "electric gap" does not occur between the first half shield cover 71 and the second half shield cover 90. Therefore, in the present invention, a width L1 with respect to X1–X2 direction of the shield cover assembly 70 is not increased by insuring that the generation of the "electric gap" does not occur.

Furthermore, as shown in FIG. 9-(D), the wall part 77 is in contact with an inside of the base part 97. The base part 78 is contacted with the base part 97. Hence, the generation of the gap does not occur between the first half shield cover 71 and the second half shield cover 90.

Besides, as shown in FIG. 3, the frame part 72 is blocked by the base part 22 of the block body 21 of the balanced transmission plug body 20.

The generation of the "electric gap" does not occur around the end parts 30-1*b* and 30-2*b* of the first and second signal contacts 30-1 and 30-2, the relay board 40, and the sub-cable 63.

Hence, an electromagnetic waves having a short wavelength and occurring from the sub-cable 63, the end parts 30-1*b* and 30-2*b*, the relay board 40, are closed in the shield cover assembly 70. Accordingly, it is limited to leak the electromagnetic waves out from the shield cover assembly 70.

In the second half shield cover 90, adjacent parts to the projection part 91 and 92 are in contact with the base part 22 of the block body 21. Therefore, when the screw 106 and 107 are driven, a moment, acting to an arrow A direction in FIG. 3, is applied on the second half shield cover 90, by taking the adjacent parts to the projection parts 91 and 92 as a fulcrum of a lever principle. The projection parts 91 and 92 of the second half shield cover 90 are respectively fit with the accepting (i.e., catching) parts 88 and 89. Accordingly, it is limited to displace the projection parts 91 and 92 to Z1 direction. Hence, in FIG. 3, by taking the projection parts 91 and 92 as defining an axis of rotation, by driving the screws 106 and 107, a force is applied, pushing the bottom edge of the side wall parts 95 and 96 to the upper edge of the side wall parts 75 and 76. Hence, the generation of a gap does not occur at a part along Y1–Y2 direction at X1 and X2 sides in the shield cover assembly 70.

The shield cover assembly 70 includes a pull lever 110. The pull lever 110 is used for pulling operation in the case that the connection of the connector is removed based on a space 109. The space 109 is formed between the outside wall parts 73, 74, 93 and 94 of the first half shield cover 71 and the outside wall parts 75, 76, 95 and 96 of the second half shield cover 90. A hook member 111, extended by pulling operation of the pull lever 110, is provided at the first half shield cover 71.

As shown in FIG. 8, a height position H1 of a contact position of the outside wall parts 73, 74, 93, and 94 of the first and second half shield covers 71 and 90 is shifted at a length 6 against a height position H2 of a contact position of the side wall parts 75, 76, 95, and 96 regarding Z1–Z2 direction. With this structure, the electromagnetic wave is prevented from leaking from the shield cover assembly 70 outside.

Next, a balanced transmission connector with a cable of another embodiment will be described.

In FIGS. 10–13, parts that are the same as the parts shown in FIG. 5 are given the same reference numerals in, and explanation thereof will be omitted.

Figure 10:
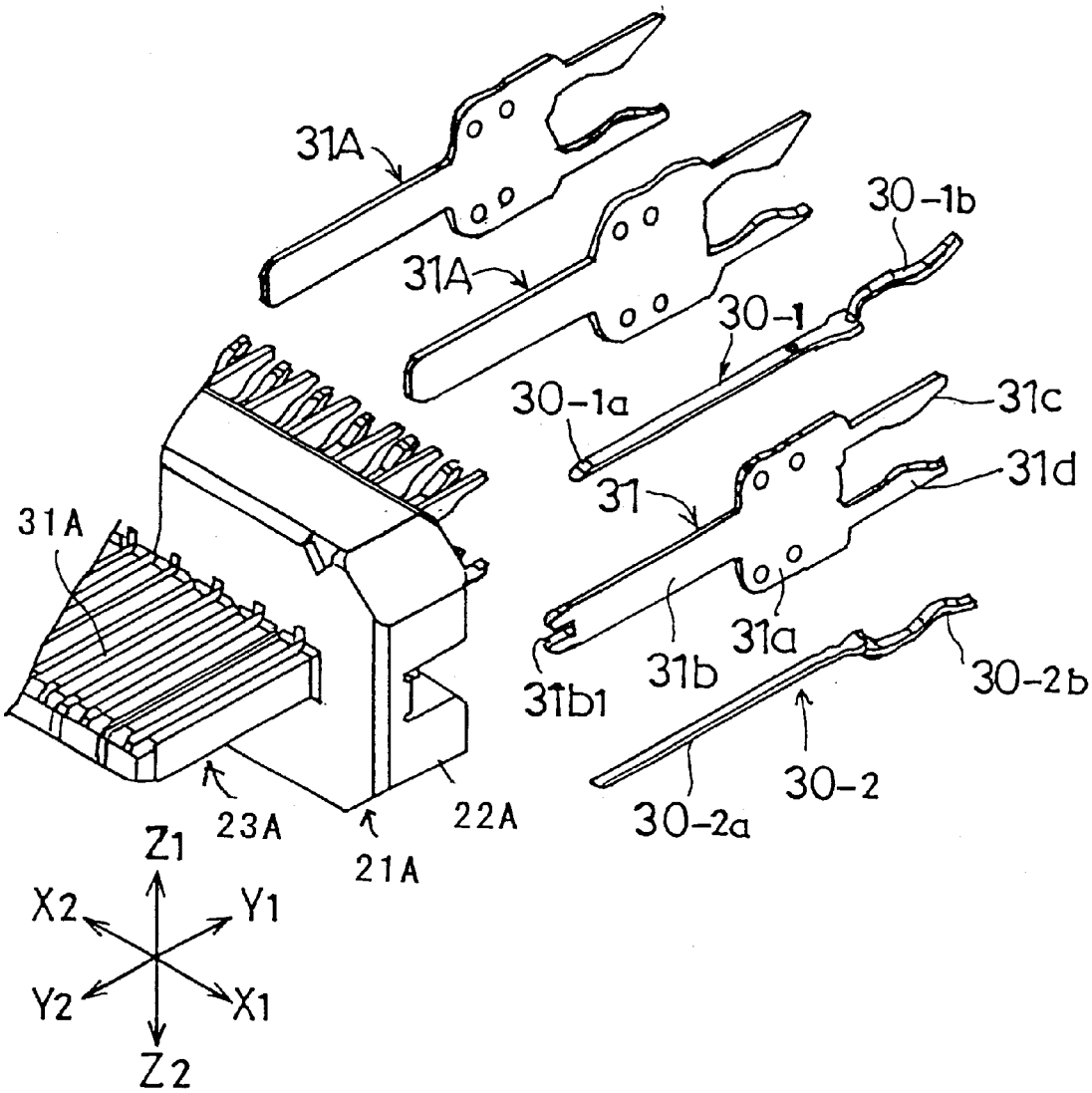
FIG. 10 is an enlarged view showing a part of a balanced transmission plug body which is a first modified example.
Figure 11:
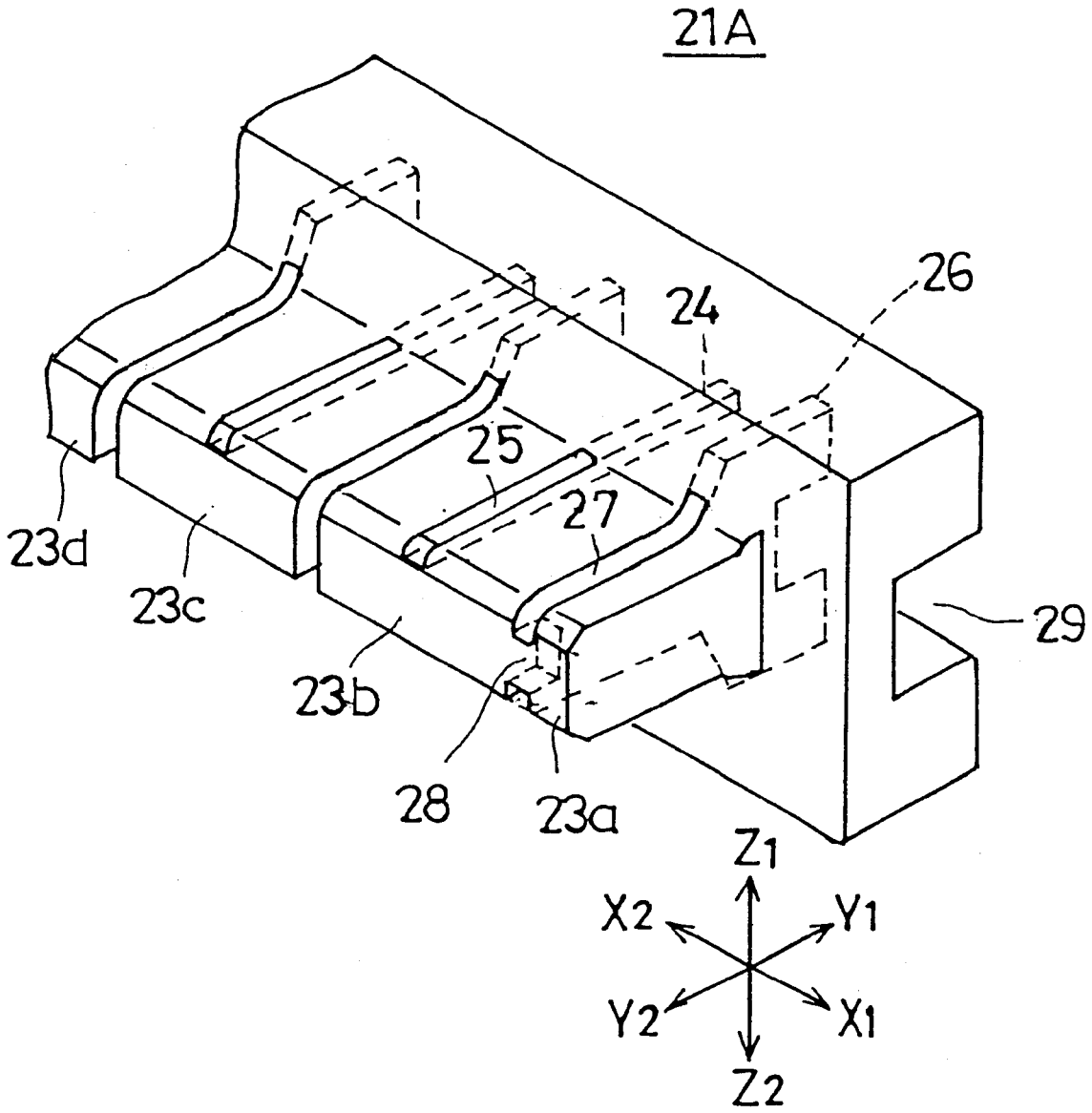
FIG. 11 is an enlarged view showing a part of the block body shown in FIG. 10.

FIG. 10 is a view showing a balanced transmission connector body 20A which is modified. FIG. 11 is a view showing a block body 21A. In this embodiment, the comb tooth part arranged on the both end parts of X1–X2 direction is connected with its inside comb tooth part by the connection part 28, in order to prevent the comb tooth part arranged on the both end parts of X1–X2 direction from being broken. That is, the comb tooth part 23*a* is connected with the comb tooth part 23*b* by the connection part 28. Comb tooth parts other than the comb tooth part 23*a* arranged on the both end parts, namely the comb tooth parts 23*b*, 23*c*, and 23*d*, are not connected to each other by the connection part 28.

Other than the both end parts, a ground contact 31A having a plate shape and not having the concave part 31*b*1 is inserted in the block body 21A.

Figure 12:
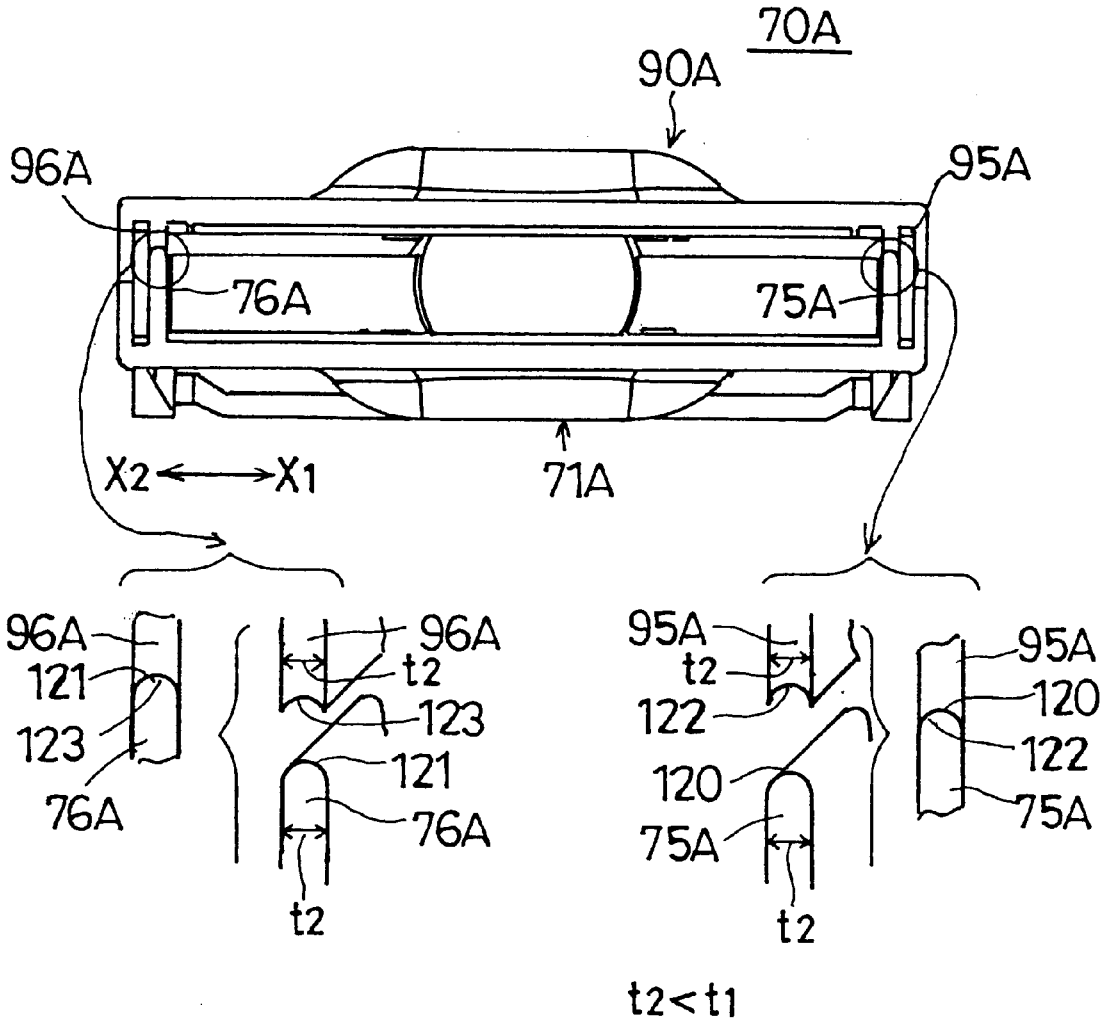
FIG. 12 is a cross sectional view as to X–Z face showing a shield cover assembly which is a first modified example.

FIG. 12 shows a view of a shield cover assembly 70A of a modified form relatively to the first example of FIGS. 1–11.

The shield cover assembly includes a first half shield cover 71A and a second half shield cover 90A. Convex parts 120 and 121 are provided on edges of side wall parts 75A and 76A of the first half shield cover 71A. The convex parts 120 and 121 have a cross section having a shape of a part of a circle.

Groove parts 122 and 123 are provided on edges of side wall parts 95A and 96A of the second half shield cover 90A. The groove parts 122 and 123 have a cross section having a shape of a part of a circle which can be clamped with the convex parts 120 and 121.

In a state where the first half shield cover 71A and the second half shield cover 90A are in contact, edges of the side wall parts 75A and 76A and the side wall parts 95A and 96A face together. Besides, the convex parts 120 and 121 are clamped with and pushed the groove parts 122 and 123. Hence, the generation of the "electric gap" does not occur between the first half shield cover 71A and the second half shield cover 90A.

If there is a weak part as to push each other between the convex parts 120 and 121 and the groove parts 122 and 123, a gap is formed partially. However, in this embodiment, the gap is not formed as going through lineally to X1–X2 direction, because the convex part 120 is clamped with the groove part 122 and the convex part 121 is clamped with the groove part 123. Hence, the gap is blocked by the convex parts 120 and 121, so that the generation of the "electric gap" does not occur between the first half shield cover 71A and the second half shield cover 90A.

Figure 13:
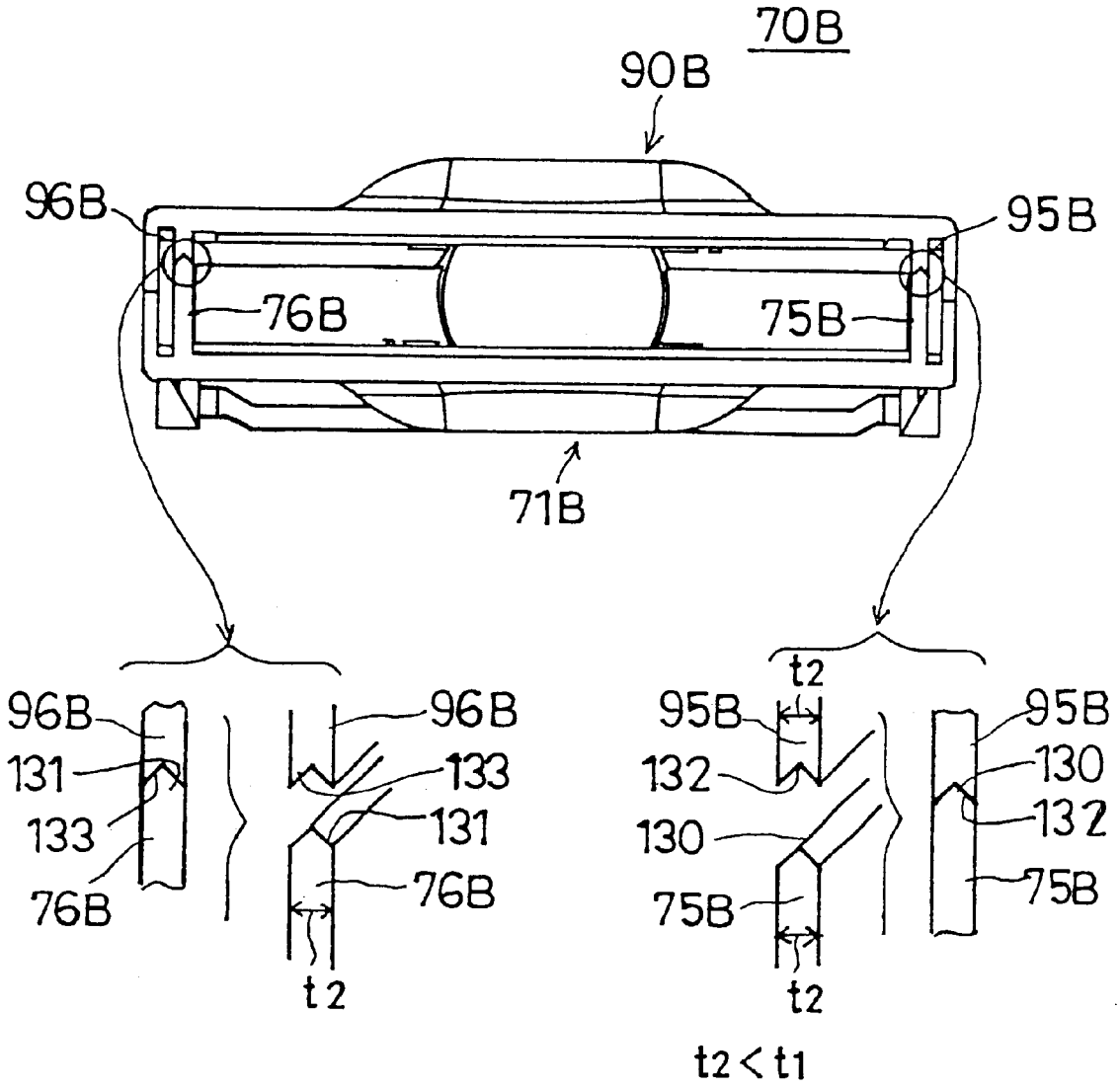
FIG. 13 is a cross sectional view as to X–Z face showing a shield cover assembly which is a second modified example.

FIG. 13 shows a view of a shield cover assembly 70B which is a second deformed example.

In this embodiment, a convex part having a triangle shape, is used, instead of the convex part having a cross section of a shape of a part of a circle of the above mentioned embodiment.

The shield cover assembly includes a first half shield cover 71B and a second half shield cover 90B.

The first half shield cover 71B includes side wall parts 75B and 76B. The side wall parts 75B and 76B of the first half shield cover 71B include convex parts 130 and 131 having a cross section of a shape of a part of a triangle on edges.

The second half shield cover 90B includes side wall parts 95B and 96B. The side wall parts 95B and 96B of the second half shield cover 90B include groove parts 132 and 133 having a cross section whose part has a triangle shape which can be clamped with the convex parts 130 and 131 on edges.

In a state where the first half shield cover 71B and the second half shield cover 90B are contacted, edges of the side wall parts 75B and 76B and the side wall parts 95B and 96B face each other. Besides, the convex parts 130 and 131 are clamped with and pushed to the groove parts 132 and 133. Hence, the generation of the "electric gap" does not occur between the first half shield cover 71B and the second half shield cover 90B.

If there is a weak part as to push each other between the convex parts 130 and 131 and the groove parts 132 and 133, a gap is formed partially. However, in this embodiment, the gap is not formed as going through lineally to X1–X2 direction, because the convex parts 130 are clamped with the groove parts 132 and the convex parts 131 are clamped with the groove parts 133. Hence, the gap is blocked by the convex parts 130 and 131, so that the generation of the "electric gap" does not occur between the first half shield cover 718 and the second half shield cover 90B.

With respect to the above mentioned side wall part 75B, 76B, 95B, and 96B, the convex parts and the groove parts are formed on a center of the edge of the side wall part. Accordingly, the width t2 of the side wall part 75B, 76B, 95B, and 96B is shorter than the width t1 of the side wall part 75, 76, 95, and 96 shown in FIG. 8.

The present invention is not limited to these embodiments, but various variations and modifications may be made without departing from the scope of the present invention.

The patent application is based on Japanese priority patent application No. 2001-249125 filed on Aug. 20, 2001, the entire contents of which are hereby incorporated by reference.

What is claimed is:

1. A balanced transmission connector comprising:

a relay board;

a plug body for balanced transmission provided on an end part of the relay board and including a first signal contact, a second signal contact, a ground contact having a plate shape, a groove for the signal contacts, a slit part having a head end, and a connecting part;

a cable for balanced transmission connected with another end part of the relay board; and a shield cover assembly which covers the relay board, the plug body for balanced transmission, and a part of the cable, wherein all or a part of the ground contacts has a convex head part, the first and second signal contacts and the ground contact are arranged in turn at a designated pitch, the first and second signal contacts are inserted into the groove for the signal contacts, the ground contact is inserted and penetrates to the slit part, the slit part has a configuration corresponding to a configuration of the convex head part of the ground contact, and the head end of the slit part is connected by the connecting part.

2. A balanced transmission connector as claimed in claim 1, wherein the shield cover assembly further comprises:

a first half shield cover, made of an electrically conductive, non-magnetic material, which includes an inside wall part having an edge and an outside wall part having an edge and being provided outside of the inside wall part of the first half shield cover and defining a double peripheral side wall of the first half shield cover;

a second half shield cover, made of an electrically conductive, non-magnetic material, which includes an inside wall part having an edge which faces the edge of the inside wall part of the first half shield cover and an outside wall part having an edge and provided outside of the inside wall part of the second half shield cover and defining a double peripheral side wall of the second half shield cover;

a concave part which is formed on the edge of the inside wall part of the first half shield cover and extends in an longitudinal direction of the inside wall part;

a convex part which is formed on the edge of the inside wall part of the second half shield cover, clamps the concave part and extends in a longitudinal direction of the inside wall part;

the first half shield cover and the second half shield cover are connectable together; and a height position, at which the edge of the outside wall part of the first half shield cover is in contact with the edge of the outside wall part of the second half shield cover, is different from a height position, at which the edge of the inside wall part of the first half shield cover is in contact with the edge of the inside wall part of the second half shield cover when the first and second half shield covers are assembled defining a terminal housing portion in the interior thereof, surrounded by the respective double peripheral sidewalls thereof.

3. The shield cover assembly as claimed in claim 2, wherein the first half shield cover further comprises a catching part provided on a frame part at a head end of the connector;

the second half shield cover further comprises an end part extending in a longitudinal direction; and the catching part of the first half shield cover catches the end part of the second seal half cover and an end of a cable is screw fixed with the first half shield cover, whereby the edges of the respective outside wall parts of the respective half shield covers are in contact.

4. The balanced transmission connector as claimed in claim 1, wherein the shield cover assembly further comprises:

a first half shield cover made of an electrically conductive, non-magnetic material and having inside wall parts, an edge of each of which has a step-shaped surface including a base flat surface and a raised flat surface extending in parallel and in a longitudinal direction of the edge and outside wall parts, each having an edge and being provided outside of the inside wall parts of the first half shield cover and defining a double peripheral side wall of the first half shield cover, the base flat surface being positioned on an interior side of the inside wall parts, and a second half shield cover made of an electrically conductive, non-magnetic material and having inside wall parts, an edge of each of which has a step-shaped surface including a base flat surface and a raised flat surface extending in parallel and in a longitudinal direction of the edge and outside wall parts having an edge and provided outside of the inside wall parts of the second half shield cover, the base flat surface of the inside wall parts of the second half shield cover being positioned on an exterior of the inside walls and defining a double peripheral side wall of the second half shield cover;

the raised flat surface of one of the first and second half shield covers is in direct contact with the base flat surface of the other one of the first and second half shield covers when the first half shield cover and the second half shield cover are connected together in an engaged condition; and a first height position, at which the edge of the outside wall part of the first half shield cover is in contact with the edge of the outside wall part of the second half shield cover, is different from a second height position, at which the edge of the inside wall parts of the first half shield cover is in contact with the edge of the inside wall parts of the second half shield cover when the first and second half shield covers are assembled, defining a terminal housing portion in the interior thereof surrounded by the respective double peripheral sidewalls thereof.

5. The balanced transmission connector as claimed in claim 1, wherein:

the first half shield cover further comprises:

a catching part provided on a frame part at a head end of the connector; and the second half shield cover further comprises:

an end part extending in a longitudinal direction; and the catching part of the first half shield cover catches the end part of the second seal half cover and an end of a cable is screw-fixed with the first half shield cover, whereby the edges of the respective outside wall parts of the respective half shield covers are in contact.

6. The balanced transmission connector as recited in claim 1, wherein the shield cover assembly further comprises:

a first half shield cover, made of an electrically conductive, non-magnetic material, which includes an inside wall part having an edge and an outside wall part having an edge and being provided outside of the inside wall part of the first half shield cover and defining a double peripheral side wall of the first half shield cover, a second half shield cover, made of an electrically conductive, non-magnetic material, which includes an inside wall part having an edge which faces the edge of the inside wall part of the first half shield cover and an outside wall part having an edge and provided outside of the inside wall part of the second half shield cover and defining a double peripheral side wall of the second half shield cover, a concave part which is formed on the edge of the inside wall part of the first half shield cover and extends in a longitudinal direction of the inside wall part, and a convex part which is formed on the edge of the inside wall part of the second half shield cover, clamps the concave part and extends in the longitudinal direction of the inside wall part;

the first half shield cover and the second half shield cover are connectable together; and a first height position, at which the edge of the outside wall part of the first half shield cover is in contact with the edge of the outside wall part of the second half shield cover, is different from a second height position, at which the edge of the inside wall part of the first half shield cover is in contact with the edge of the inside wall part of the second half shield cover when the first and second half shield covers are assembled, defining a terminal housing portion in the interior thereof surrounded by the respective double peripheral sidewalls thereof.

7. The balanced transmission connector as claimed in claim 6, wherein the convex part has a cross section of a circular configuration and the concave part has a cross section of a circular groove configuration which can be clamped with the cross section of the convex part.

8. The balanced transmission connector as claimed in claim 6, wherein the convex part has a cross section of a triangular configuration and the concave part has a cross section of a groove configuration which can be clamped with the convex part.

9. The balanced transmission connector as claimed in claim 6, wherein:

the first half shield cover further comprises a catching part provided on a frame part at a head end of the connector;

the second half shield cover further comprises an end part extending in a longitudinal direction; and the catching part of the first half shield cover catches the end part of the second seal half cover and an end of a cable is screw-fixed with the first half shield cover, whereby the edges of the respective outside wall parts of the respective half shield covers are in contact.

* * * * *